US005662744A

United States Patent [19]

Tuller et al.

[11] Patent Number: 5,662,744

[45] Date of Patent: Sep. 2, 1997

[54] WASH ARM FOR DISHWASHER

[75] Inventors: Barry E. Tuller; Thomas M. Johnson, both of Newton, Iowa

[73] Assignee: Maytag Corporation, Newton, Iowa

[21] Appl. No.: 659,169

[22] Filed: Jun. 5, 1996

[51] Int. Cl.[6] ..... B08B 3/02

[52] U.S. Cl. ..... 134/25.2; 134/176; 134/179; 239/258; 239/222.17; 239/251

[58] Field of Search ..... 134/183, 176, 134/171, 198, 201, 56 D, 57 D, 58 D, 25.2, 34; 239/DIG. 19, 265.19, 255, 258, 256, 251, 227.17

[56] References Cited

U.S. PATENT DOCUMENTS

| | | | |
|---|---|---|---|
| 2,013,387 | 9/1935 | Johnston | 141/9 |
| 2,673,761 | 3/1954 | Karlstrom | 134/179 |
| 2,854,141 | 9/1958 | Barnstead | 210/167 |
| 2,987,260 | 6/1961 | Sasnett | 239/231 |
| 3,267,944 | 8/1966 | Meeker et al. | 134/179 |
| 3,362,645 | 1/1968 | Clark | 239/251 |
| 3,496,949 | 2/1970 | Mrecer | 239/251 |
| 3,672,573 | 6/1972 | Morgan . | |
| 3,770,203 | 11/1973 | Dyar | 134/179 |
| 3,774,626 | 11/1973 | Schweitzer | 134/179 |
| 3,809,106 | 5/1974 | Crabtree | 134/176 |
| 4,172,463 | 10/1979 | Woolley et al. | 134/176 |
| 4,266,565 | 5/1981 | Gurubatham | 134/176 |
| 4,301,822 | 11/1981 | Dingler | 134/176 |
| 4,418,868 | 12/1983 | Gurubatham et al. | 134/179 |
| 5,143,513 | 9/1992 | Ellingson et al. | 134/176 |
| 5,211,190 | 5/1993 | Johnson et al. | 134/180 |
| 5,267,582 | 12/1993 | Purtilo | 134/180 |
| 5,546,968 | 8/1996 | Jeon et al. | 134/179 |

OTHER PUBLICATIONS 133,149 Eueopean Patent Application (EPO) 239/222.17.

*Primary Examiner*—Frankie L. Stinson
*Attorney, Agent, or Firm*—Zarley, McKee, Thomte, Voorhees and Sease

[57] ABSTRACT

A one-piece wash arm is provided for a dishwasher. The wash arm has an open channel through which water from a water supply hose is directed. The channel has opposite curved ends with discharge openings through which the water is sprayed onto objects to be washed in the dishwasher. The flow of water through the channel and the curved ends imparts rotation to the wash arm. In a preferred embodiment, the open channel is downwardly facing, and the water is substantially maintained in the channel due to the water pressure, velocity and surface tension. In an alternative embodiment, the open channel is directed upwardly.

32 Claims, 3 Drawing Sheets

Fig. 3

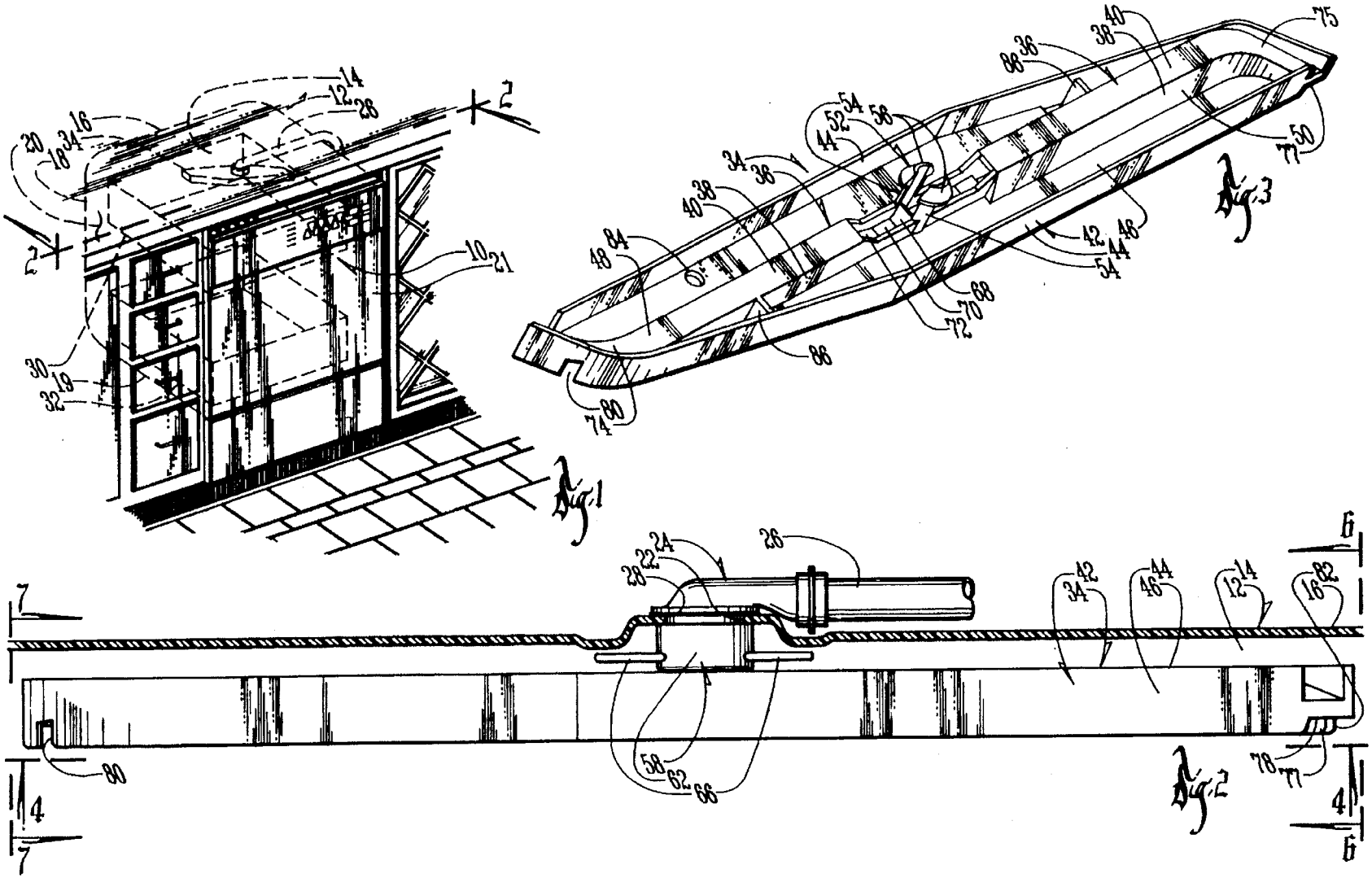

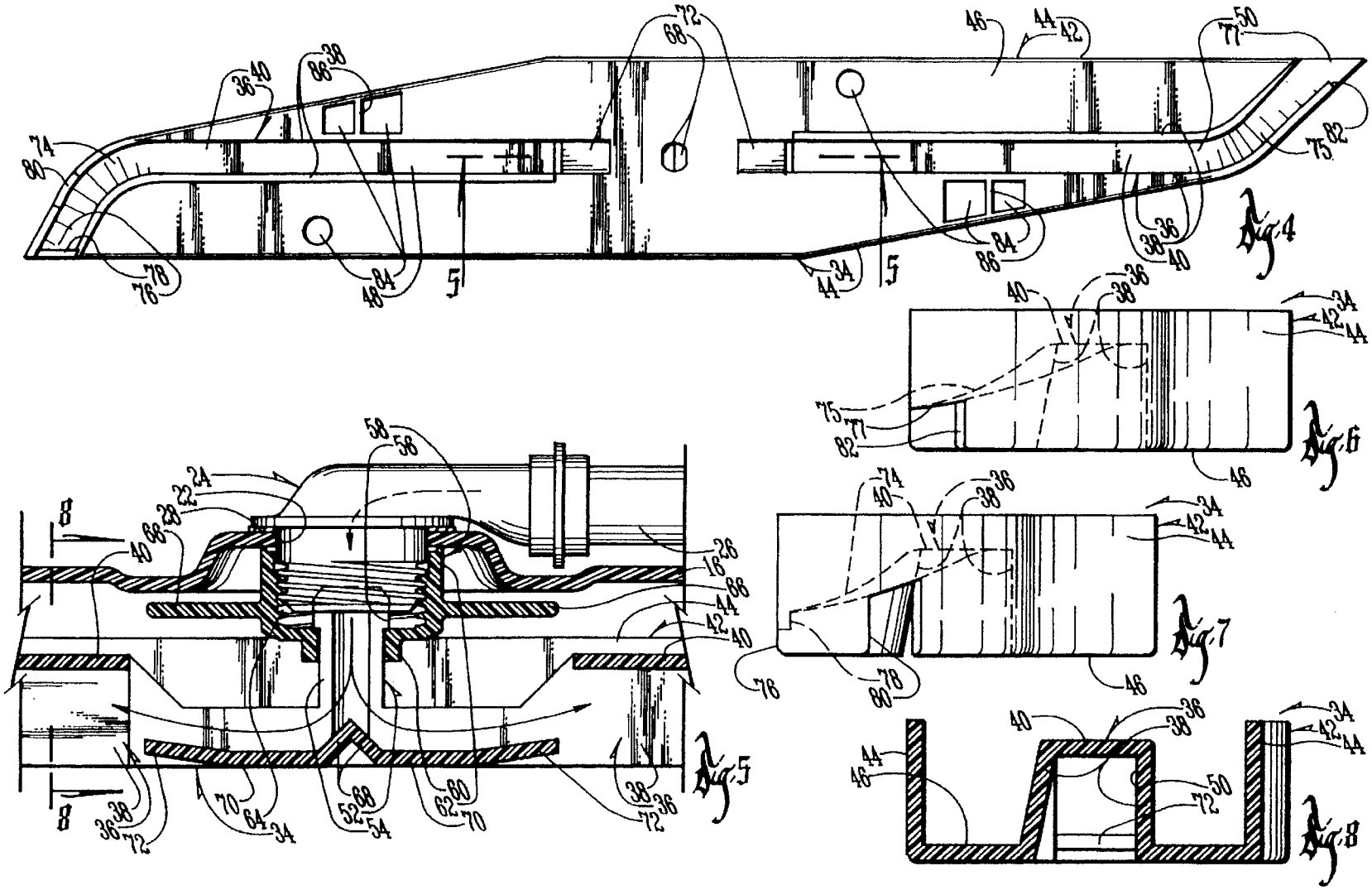

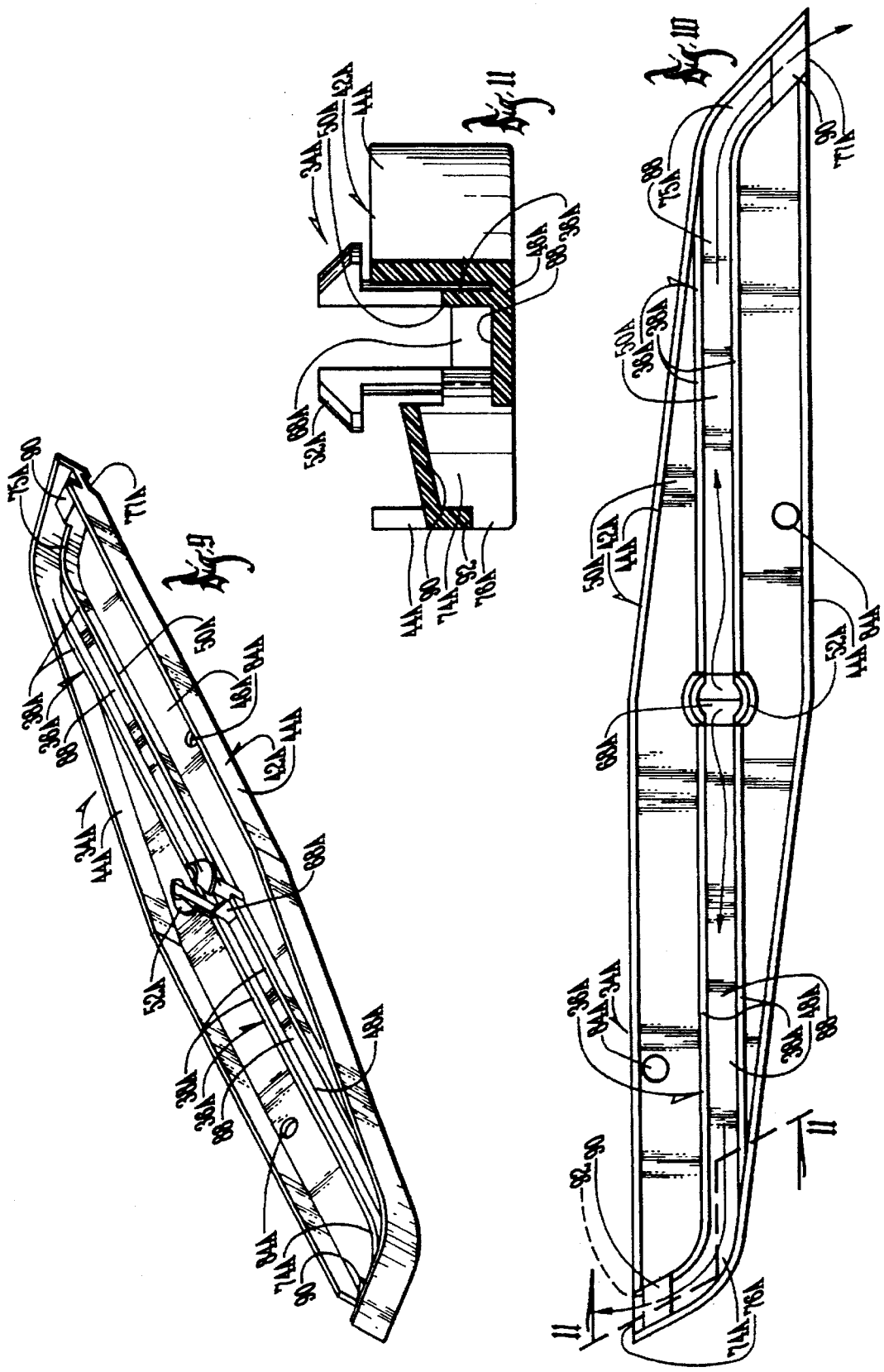

WASH ARM FOR DISHWASHER

BACKGROUND OF THE INVENTION

Conventional dishwashers have one or more rotating wash arms for dispensing a spray of water onto the objects in the dishwasher racks for cleaning. Modern dishwashers utilize molded plastic wash arms, which typically are formed in two pieces that are welded together to provide a water conduit with one or more discharge openings through which the water is emitted. The ejection of the water through the discharge openings also can impart rotational movement to the wash arm, thereby providing a pattern of spray throughout the washing chamber of the dishwasher.

The multi-piece construction of conventional wash arms increases manufacturing costs due to the number of pieces and the assembly operation which is required. Therefore, it is desirable to reduce the number of manufactured components so as to minimize manufacturing costs and time.

A primary objective of the present invention is the provision of an improved dishwasher wash arm.

Another objective of the present invention is the provision of a one-piece molded wash arm for a dishwasher.

A further objective of the present invention is the provision of a wash arm for a dishwasher, wherein the wash arm has an open channel for directing water to be sprayed into the washing chamber.

Still another objective of the present invention is the provision of a single-piece wash arm having a downwardly facing open channel through which water is directed and maintained by water pressure, velocity and surface tension.

Another objective of the present invention is the provision of an improved wash arm which is economical to manufacture, and durable and efficient in use.

These and other objectives will become apparent from the following description of the invention.

SUMMARY OF THE INVENTION

The improved wash arm of the present invention includes a one-piece molded arm member which is rotatably mountable to the water supply line or hose of the dishwasher. An elongated water channel is formed in the arm member and is adapted to receive water from the water supply hose. The channel has opposite ends with discharge openings at each end for discharging the water in a controlled pattern of spray into the washing chamber for cleaning objects therein. Preferably, the discharge openings at each end of the channel are different so as to produce different spray patterns in the washing chamber.

The channel is open substantially along its length, and has two branches extending in opposite directions from the central mounting hub of the arm member. The channel is U-shaped and defined by opposite side walls and a connecting wall. The opposite ends of the channel are curved in opposite directions such that the flow of water through the channels imparts rotation to the arm member.

In a preferred embodiment, the channel opening is directed downwardly. As the water is directed into the opposite branches of the channel from the water supply hose, the water is ramped upwardly into engagement with the top wall of the channel. The water pressure, velocity and surface tension maintains the water in the channel for discharge through the discharge openings at the opposite ends of the channel.

In a second embodiment, the channel opening is directed upwardly, and the water flows through the channel before being discharged through the discharge openings at the opposite ends of the channel.

BRIEF DESCRIPTION OF THE DRAWINGS

FIG. 1 is a perspective view of a dishwasher showing an upper wash arm in broken lines.

FIG. 2 is an enlarged sectional view taken along lines 2—2 of FIG. 1 showing a preferred embodiment of the wash arm of the present invention.

FIG. 3 is a perspective view of the preferred embodiment of the wash arm.

FIG. 4 is a bottom plan view of the preferred embodiment of the wash arm.

FIG. 5 is a sectional view taken along lines 5—5 of FIG. 4.

FIG. 6 is an end elevational view taken along lines 6—6 of FIG. 2.

FIG. 7 is an end elevational view taken along lines 7—7 of FIG. 2.

FIG. 8 is a sectional view taken along lines 8—8 of FIG. 5.

FIG. 9 is a perspective view of a second embodiment of a wash arm in accordance with the present invention.

FIG. 10 is a top plan view of the wash arm shown in FIG. 9.

FIG. 11 is a sectional view taken along lines 11—11 of FIG. 10.

DETAILED DESCRIPTION OF THE INVENTION

With reference to the drawings, a dishwasher 10 includes a tub 12 which defines a washing chamber 14. The tub includes a top wall 16, side walls 18, a bottom wall 19, and a rear wall 20. A door 21 is movable between open and closed positions relative to the front access opening of the tub. The top wall 16 has an opening 22 through which an inlet 24 of a water supply hose 26 extends. A gasket 28 provides a water tight seal around the opening 22. The dishwasher 10 typically includes an upper rack 30 and a lower rack 32 for holding objects to be washed.

The above description of the dishwasher 10 is conventional and does not constitute a part of the present invention.

The present invention is directed towards an improved wash arm 34 for dispensing a controlled spray of water onto the objects in the racks 30, 32. While the wash arm 34 is shown to be at the top of the washing chamber 14, it is understood that a similar wash arm may be used at the bottom of the washing chamber 14. The wash arm 34 is made from one-piece molded plastic, which eliminates the more costly and time consuming manufacture of multiple-piece wash arms, as in the prior art.

A preferred embodiment of the wash arm 34 is shown in FIGS. 2–8. The wash arm 34 includes an elongated channel 36 defined by side walls 38 and a top wall 40. The channel 36 is provided with structural rigidity by a wash arm body or member 42 having opposite sides 44 and a bottom wall 46.

As best shown in FIG. 8, the side walls 38 of the channel 36 diverge from one another such that the channel width is greater at the bottom of the channel than at the top of the channel. As seen in the drawings, the channel is three-sided so as to be open substantially along its length. The opening in the inverted U-shaped channel 36 is directed downwardly. The channel includes opposite branches 48, 50 extending in opposite directions from a central hub 52.

The hub includes opposite upstanding legs 54, each of which terminate in a securing flange or lip 56. The hub 52 rotatably secures the wash arm 34 to the top wall 16 of the tub 12 through the use of a nut 58. The nut 58 includes a collar 60 through which the hub 52 extends such that the securing lips 56 are snap fit into the collar 60. The body 62 of the nut 58 includes threads 64 for threadably receiving the inlet 24 of the water supply hose 26. Wings or handles 66 are provided on the nut 58 to allow tightening of the nut 58 onto the water supply hose inlet 24.

The wash arm 34 includes an inverted V-shaped water diverter 68 at the bottom of the hub 52, as best seen in FIG. 5. The diverter 68 directs water coming through the hub 52 from the water supply hose 26 into each branch 48, 50 of the channel 36. The diverter 68 terminates in a substantially horizontal bottom wall 70 with upwardly ramped ends 72 which direct the water upwardly towards the top wall 40 of the channel 36, as shown by the arrows in FIG. 5.

Each branch 48, 50 of the channel 36 includes outer ends 74 and 75 which curve in opposite directions from one another and at 25 degree and 45 degree angles respectively from channel 36, as shown in FIG. 4. This curvature of the ends 74 and 75 of the channel 36 imparts rotation to the wash arm 34 by the force of the water moving through the channel 36. The top wall 40 of the channel 36 is sloped downwardly adjacent each end 74 and 75 so as to direct water downwardly into the washing chamber 14. Each end 74 and 75 of the channel 36 terminates in discharge openings 76 and 77 for the discharge of water from the channel 36. The end of the channel 36 on the branch 48 includes a small dam 78 across a portion of the discharge opening 76 so as to provide a different spray pattern than from the discharge opening 77 of the branch 50. The branch 48 also includes a secondary discharge opening 80 to provide additional spray coverage within the washing chamber 14. As best shown in FIGS. 4 and 6, in branch 50, the outer side wall 38 stops short of the opening 77 so as to define a notch 82 to provide an additional spray pattern of water from the branch 50 of the channel 36.

It is to be noted that the open channel 36 faces downwardly. Despite the downward orientation of the channel 36, substantially all of the water flowing through the channel 36 is sprayed from the outer ends 74 of the channel 36, rather than falling by gravity from the open channel 36 along its length. The water pressure, velocity and surface tension maintains substantially all of the water in the channel 36 until the water is sprayed from the discharge openings 76, 77 and 80.

The body 42 includes drainage holes 84 for draining water and food particles which may collect on the bottom wall 46 of the body 42. A blockage wall 86 extends between the respective side walls 38 of the channel 36 and the sides 44 of the wash arm 34 so as to block and prevent food materials from becoming wedged or plugged into the converging wall structure of the wash arm 34.

In operation, the dishwasher 10 is turned on, and at predetermined times as determined by the dishwasher controls (not shown), water is supplied through the water supply hose 26. The water is directed through the hub 52 and directed to the opposite branches 48, 50 of the wash arm 34 by the diverter 68. The diverted water is directed upwardly and outwardly by the ramped ends 72 of the diverter bottom wall 70 so as to flow through the branches 48, 50 of the channel 36 to the outer ends 74 and 75 thereof. The discharge of the water through the discharge openings 76, 77 and 80 at the curved ends 74 and 75 of the channels 36 imparts rotation to the wash arm 34. The discharge openings 76 and 77, the secondary discharge opening 80, the dam 78 and the notch 82 provide a controlled spray pattern of water onto the objects placed in the upper rack 34 within the washing chamber 14.

A second embodiment of a wash arm 34A is shown in FIGS. 9–11. The same reference numerals will be used for similar structure in both embodiments, with the suffix A being added to the reference numerals of the second embodiment.

The wash arm 34A includes an upwardly facing channel 36A having opposite curved ends 74A and 75A. The channel 36A includes parallel side walls 38A and a bottom wall 88. A wash arm body 42A with sides 44A and a bottom wall 46A provide structural support for the channel 36A.

The channel 36A includes opposite branches 48A and 50A. A central hub 52A is provided for securing the wash arm 34A to a nut as described above with respect to the preferred embodiment wash arm 34. An inverted V-shaped diverter 68A is provided on the wash arm 34A to direct water to both branches 48A and 50A. In the second embodiment of the wash arm 34A, the opposite ends 74A and 75A of the channel 36A are also angled with respect to channel 36A. Discharge opening 76A is angled at about 25 degrees with respect to branch 48A of channel 36A and discharge opening 77A is angled at about 45 degrees with respect to branch 50A and spray water onto the objects in the washing chamber 14 of the dishwasher 10. A downwardly sloped water deflection ramp 90 is provided above the discharge openings 76A and 77A so as to direct water downwardly from the wash arm 34A. The ramp 90 terminates in a short vertical dam 92. The wash arm body 42A includes drainage holes 84A for draining water from the arm body 42A.

The operation of the second embodiment of the wash arm 34A is substantially the same as the operation of the preferred embodiment wash arm 34, except that the channel 36A is upwardly facing, as opposed to the downwardly facing channel 36A of the preferred embodiment.

The one-piece molded construction of the wash arms 34 and 34A, with the open channels 36, 36A, provides an effective and efficient dishwasher component which is economical to manufacture, easy to assemble, and efficient in use.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. A wash arm for a dishwasher having a washing chamber and being operatively connected to a source of water, the wash arm comprising:

a one-piece arm member adapted to be rotatably mounted in the washing chamber;

an elongated water channel formed in the arm member along substantially the entire length of the arm member and being adapted to receive water from the water source;

the water channel having opposite ends with a discharge opening at each end for discharging a spray of water into the washing chamber.

2. The wash arm of claim 1 wherein the channel is open substantially along its length.

3. The wash arm of claim 1 wherein the channel includes opposite side walls, a top wall, and an open bottom.

4. The wash arm of claim 3 wherein the top wall is sloped downwardly adjacent the opposite ends of the channel.

5. The wash arm of claim 3 wherein the channel includes upwardly inclined ramps for directing water toward the top wall.

6. The wash arm of claim 3 wherein the side walls diverge from one another from top to bottom.

7. The wash arm of claim 1 wherein the channel includes opposite side walls, a bottom wall, and an open top.

8. The wash arm of claim 1 wherein the channel has a primary axis and the opposite ends are curved in opposite directions from the axis such that the discharge of water from the discharge openings imparts rotation to the arm member.

9. The wash arm of claim 1 wherein the channel includes a central diverter to direct water to the opposite ends of the channel.

10. The wash arm of claim 1 wherein one end of the channel includes a second discharge opening to further distribute water in the washing chamber.

11. The wash arm of claim 1 wherein one end of the channel includes a dam adjacent the discharge opening to direct the spray of water into the washing chamber.

12. The wash arm of claim 1 wherein the channel has an inverted U-shape in cross section.

13. The wash arm of claim 1 wherein the channel has a U-shape in cross section.

14. A rotatable wash arm for directing a spray of water within a washing chamber of a dishwasher, the wash arm comprising:

an elongated one-piece arm member having opposite ends;

an open channel extending along the length of the arm member and having a discharge opening at each end of the arm member;

a water diverting member disposed between said opposite ends for diverting water toward the discharge opening at each end of the arm member, wherein said diverting member extends only partially through said open channel; and a central hub extending from the arm member for rotatably mounting the wash arm to the dishwasher.

15. The wash arm of claim 14 wherein the channel is open substantially along the length of the arm member.

16. The wash arm of claim 14 wherein the arm member, channel and hub have a one-piece molded construction.

17. The wash arm of claim 14 wherein the channel includes opposite side walls, a top wall, and an open bottom.

18. The wash arm of claim 17 wherein the top wall is sloped downwardly adjacent the opposite ends of the channel.

19. The wash arm of claim 17 wherein the channel includes upwardly inclined ramps for directing water toward the top wall.

20. The wash arm of claim 17 wherein the side walls diverge from one another from top to bottom.

21. The wash arm of claim 14 wherein the channel includes opposite side walls, a bottom wall, and an open top.

22. The wash arm of claim 14 wherein the channel has a primary axis and the opposite ends are curved in opposite directions from the axis such that the discharge of water from the discharge openings imparts rotation to the arm member.

23. The wash arm of claim 14 wherein the channel includes a central diverter to direct water to the opposite ends of the channel.

24. The wash arm of claim 14 wherein one end of the channel includes a second discharge opening to further distribute water in the washing chamber.

25. The wash arm of claim 14 wherein one end of the channel includes a dam adjacent the discharge opening to direct the spray of water into the washing chamber.

26. The rotatable wash arm of claim 14 wherein said water diverting member is triangular shaped with one point of the triangular shaped diverting member being pointed toward the central hub.

27. The rotatable wash arm of claim 14 wherein said elongated one-piece arm member further comprises a body portion formed outside the channel, the body portion extending along the length of the open channel for providing structural strength to the elongated one-piece arm member.

28. A method of providing a controlled spray of water within a washing chamber of a dishwasher, comprising:

providing a rotatable wash arm mounted in the washing chamber;

directing water to the rotatable wash arm;

diverting the water in opposite directions through an elongated open channel having opposite ends with discharge openings and a central water inlet by positioning a diverting member entirely within the channel in line with the central water inlet;

substantially maintaining the water in the channel between the water inlet and discharge openings; and discharging the water through the openings at the opposite ends of the channel for spray into the washing chamber.

29. The method of claim 28 wherein the open channel faces downwardly, and the water is maintained in the channel by pressure, velocity and surface tension.

30. The method of claim 29 further comprising ramping water upwardly into engagement with a top wall of the channel as the water enters the channel.

31. The method of claim 28 wherein the channel has a longitudinal axis, the method further comprising discharging the water at an angle relative to the longitudinal axis of the channel, so as to facilitate rotation of the wash arm.

32. The method of claim 28 further comprising ramping the water downwardly as the water exits the discharge openings.

* * * * *